US005339774A

United States Patent [19]

Tang

[11] Patent Number: 5,339,774

[45] Date of Patent: Aug. 23, 1994

[54] FLUIDIZED BED STEAM GENERATION SYSTEM AND METHOD OF USING RECYCLED FLUE GASES TO ASSIST IN PASSING LOOPSEAL SOLIDS

[75] Inventor: John T. Tang, Easton, Pa.

[73] Assignee: Foster Wheeler Energy Corporation, Clinton, N.J.

[21] Appl. No.: 89,981

[22] Filed: Jul. 6, 1993

[51] Int. Cl.[5] ..... F22B 1/00

[52] U.S. Cl. ..... 122/4 D; 110/245; 110/215; 110/216

[58] Field of Search ..... 110/245, 215, 216; 122/4 D

[56] References Cited

U.S. PATENT DOCUMENTS

| | | | |
|---|---|---|---|
| 4,196,676 | 4/1980 | Brown et al. . | |
| 4,355,601 | 10/1982 | Hattiangadi . | |
| 4,416,418 | 11/1983 | Goodstine et al. . | |
| 4,522,154 | 6/1985 | Taylor et al. | 110/245 |
| 4,686,939 | 8/1987 | Stromberg | 110/245 |
| 4,741,290 | 5/1988 | Krieger et al. | 110/245 |
| 4,766,851 | 8/1988 | Emsperger et al. | 110/245 |
| 4,776,288 | 10/1988 | Beisswenger et al. . | |
| 4,929,255 | 5/1990 | Hakulin et al. . | |
| 4,940,007 | 7/1990 | Hiltunnen et al. | 122/4 D |
| 4,969,930 | 11/1990 | Arpalahti . | |
| 5,069,171 | 12/1991 | Hansen et al. | 122/4 D |

*Primary Examiner*—Henry C. Yuen
*Attorney, Agent, or Firm*—Marvin A. Naigur

[57] ABSTRACT

A fluidized bed steam generation system and method in which recycled flue gases are used to assist in passing solid particulate material from the separator, through the loopseal, and back into the furnace. The solid particulate material separated in the cyclone separator and passed back to the furnace is assisted by recycled flue gases which have passed through the heat recovery section, an air heater, and a baghouse. The use of the recycled flue gases decreases the oxygen content which can cause oxidizing or burning of the solid particulate material which results in overheating or agglomeration of the loopseal.

15 Claims, 1 Drawing Sheet

FLUIDIZED BED STEAM GENERATION SYSTEM AND METHOD OF USING RECYCLED FLUE GASES TO ASSIST IN PASSING LOOPSEAL SOLIDS

BACKGROUND OF THE INVENTION

This invention relates to a fluidized bed steam generation system and a method of operating same and, more particularly, to such a system and method in which recycled flue gases are used to assist in passing separated solids from a separator section to a furnace section.

Fluidized bed steam generation systems are well known. In these arrangements, air is passed through a bed of particulate material, including a fossil fuel such as coal and an adsorbent for the sulfur generated as a result of combustion of the coal, to fluidize the bed and to promote the combustion of the fuel at a relatively low temperature. When the heat produced by the fluidized bed is utilized to convert water to steam, such as in a steam generator, the fluidized bed system offers an attractive combination of high heat release, high sulphur adsorption, low nitrogen oxide emissions, and high fuel flexibility.

The most typical fluidized bed utilized in the furnace section of these type systems is commonly referred to as a "bubbling" fluidized bed in which the bed of particulate material has a relatively high density and a well-defined, or discrete, upper surface.

Other types of fluidized beds utilize a "circulating" fluidized bed. According to this technique, the fluidized bed density may be below that of a typical bubbling fluidized bed, the air velocity is equal to or greater than that of a bubbling bed, and the flue gases passing through the bed entrain a substantial amount of the fine particulate solids to the extent that they are substantially saturated therewith.

These circulating fluidized bed systems are characterized by relatively high solids recycling which makes the system insensitive to fuel heat release patterns, thus minimizing temperature variations, and therefore, stabilizing the emissions at a low level. The high solids recycling also improves the efficiency of the mechanical device used to separate the gas from the solids for solids recycle, and the resulting increase in sulfur adsorbent and fuel residence times reduces the adsorbent and fuel consumption.

In the event the reactor is in the form of a steam generator, the walls of the reactor are usually formed by a plurality of heat transfer tubes. The heat produced by combustion within the fluidized bed is transferred to a heat exchange medium, such as water, circulating through the tubes. The heat transfer tubes are usually connected to a natural water circulation circuitry, including a steam drum, which separates the water from the converted steam, which is routed either to a turbine to generate electricity or to a steam user.

In these arrangements, the gaseous product from the furnace is often passed through a cyclone separator, which separates the entrained solid particulate material from the gaseous mixture and recycles the solid particulate material back into the furnace through a loopseal and a J-valve. The gaseous remainder from the cyclone separator is passed through a heat recovery section and to a baghouse in which the gases are drawn through bag filters using an induction draft fan to separate any remaining fine particulate material from the gases.

In transporting the solid particulate material separated in the cyclone separator back into the furnace, air has been used to assist the movement of the material through the loopseal and into the furnace. However, when the recycled particulate material contains fine-size char it often combusts if air, which typically contains approximately 21% oxygen, is used to assist in passing the solid particulate material through the loopseal. The combustion raises the temperature of the material in the loopseal to relatively high levels. Further, when low grade fuels are used that contain a moderate to high amount of vanadium in their ash, low eutectic vanadium oxide compounds are formed when mixed with air. The combination of increased temperature caused by the combustion and the agglomeration of vanadium result in plugging of the loopseal which can cause shutdown and considerably reduce the efficiency of the system.

SUMMARY OF THE INVENTION

It is therefore an object of the present invention to provide a system and method of the above type in which a portion of the gases from the baghouse are used to assist in passing the solid particulate material through the loopseal.

It is a further object of the present invention to provide a system and method of the above type in which overheating of the solid particulate material in the loopseal is prevented.

It a further object of the present invention to provide a system and method of the above type which prevents agglomeration of the solid particulate material in the loopseal.

It is a further object of the present invention to provide a system and method of the above type which decreases the oxygen content of the gases used to assist in passing the solids through the loopseal.

It is a further object of the present invention to provide a system and method of the above type which increases the overall efficiency of the steam generation system.

Toward the fulfillment of these and other objects, according to the system of the present invention, the gaseous material created in the furnace section is directed to a cyclone separator, which separates the entrained solid particulate material from the gaseous material. The solid particulate material is recycled to the furnace section through a loopseal and a J-valve. The gaseous material from the cyclone separator is passed through a heat recovery section and then into an air heater in which cool air is added by a force draft fan and heated by the gaseous material. The gases are then drawn through bag filters in the baghouse by an induced draft fan. A portion of the remaining gases, which contain a relatively low amount of oxygen, is recycled and used to assist in passing the solid particulate material through the loopseal and the J-valve. The lower oxygen content prevents the oxidation and combustion of the solid particulate material in the loopseal.

BRIEF DESCRIPTION OF THE DRAWINGS

The above brief description, as well as further objects, features, and advantages of the present invention will be more fully appreciated by reference to the following detailed description of the presently preferred but nonetheless illustrative embodiment in accordance with the present invention when taken in conjunction with the accompanying drawing which is a schematic representation depicting the system of the present invention.

DESCRIPTION OF THE PREFERRED EMBODIMENT

Figure 1:
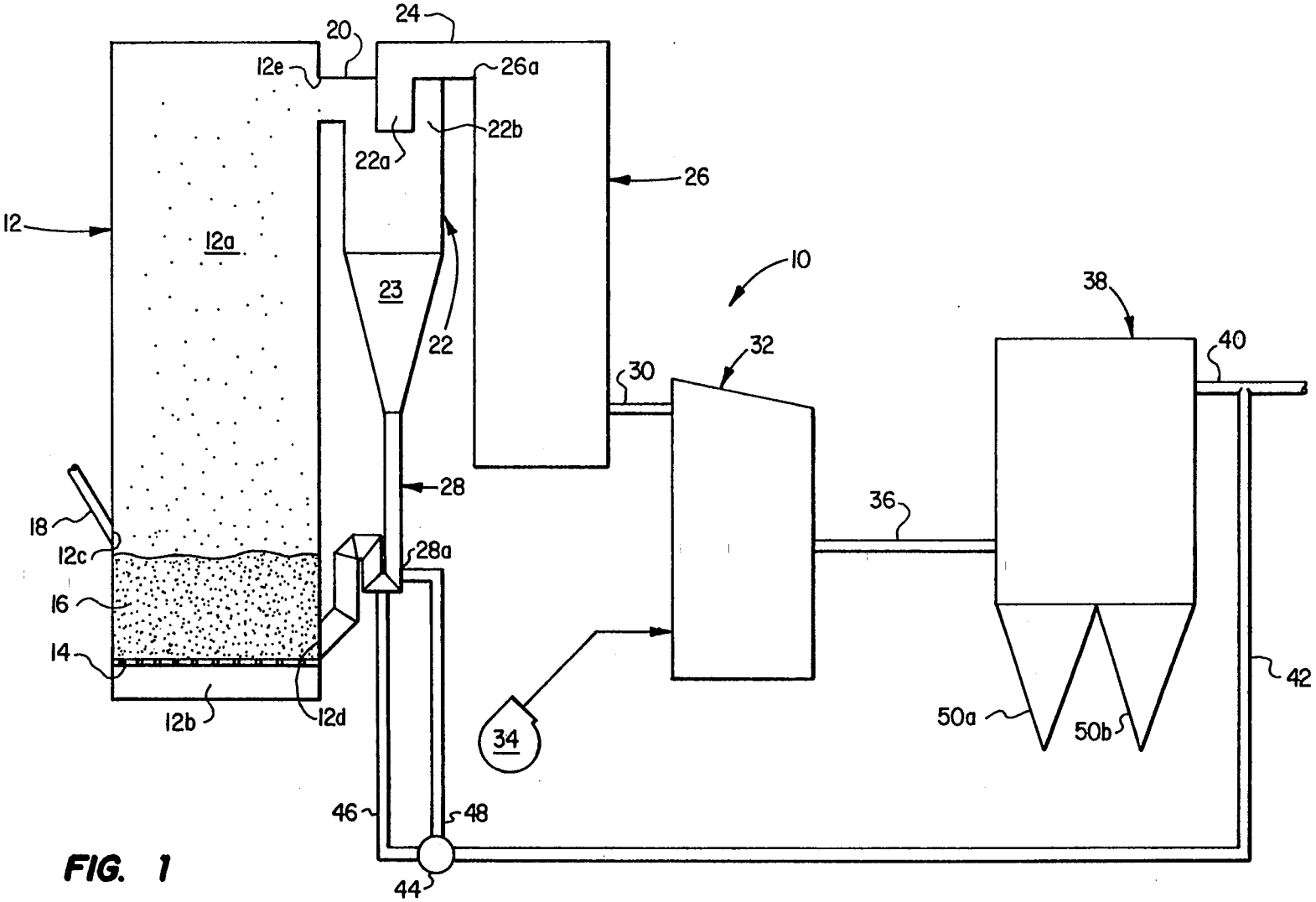

Referring specifically to FIG. 1 of the drawings, the reference numeral 10 refers, in general, to the fluidized bed steam generation system of the present invention, which includes a furnace section 12 formed, in part, by an upright enclosure 12*a*. An air distributor, or grate 14, extends across the lower end of the enclosure 12*a* to define an air plenum 12*b* beneath the air distributor 14 for directing pressurized air from a source (not shown) through the air distributor 14 and upwardly through the enclosure 12*a*. A bed of particulate material 16 is supported on the air distributor 14 and extends the entire height of the enclosure 12*a*. The density of the particulate material in the enclosure 12*a* decreases as the distance from the air distributor 14 increases. A feeder inlet opening 12*c* and a recycle inlet opening 12*d* are provided through the walls of the enclosure 12*a* to allow particulate material to be introduced into the bed 16. The feeder inlet opening 12*c* is connected to and registers with a distributor pipe 18, through which new material is introduced to the bed 16. The introduction of recycled material through the recycle inlet opening 12*d* will be described.

It is understood that the walls of the enclosure 12*a* are formed by a plurality of vertically-disposed tubes interconnected by vertically elongated bars or fins to form a substantially rectangular, contiguous, and air-tight structure. Flow circuitry (not shown) is provided to pass water through the tubes to convert the water to steam. Since this type of structure is conventional, it is not shown in the drawings nor will it be described in any further detail.

An opening 12*e* formed in the upper portion of the enclosure 12*a* by bending back some of the tubes (not shown) forming a wall of the enclosure 12*a*. A duct 20 connects the opening 12*e* with a cyclone separator 22 disposed adjacent the enclosure 12*a*.

The cyclone separator 22 includes an inner barrel 22*a* provided in its upper portion 22 to define an annular chamber 22*b*. A hopper 23 is positioned below the separator 22 and is connected to, and is integral with, the walls of the separator 22. The inner barrel 22*a* is connected, by a duct 24, with a heat recovery section 26 disposed adjacent the separator 22. A loopseal 28 connects the lower portion of the hopper 23 with the furnace section 12, through the recycle inlet opening 12*d*. The loopseal 28 contains a J-valve 28*a* for preventing the backflow of solids and/or gases directly from the furnace section 12 to the separator 22.

The heat recovery section 26 has an opening 26*a* formed in its upper wall portion which receives the gases from the duct 24. The heat recovery section 26 is of conventional construction for transferring heat from the hot gases to a cooling fluid, such as water, which passes through heat exchange tubes, or the like (not shown), provided in the heat recovery section 26 and connected in the same flow circuit as the walls of the enclosure 12*a*.

A gas flow duct 30 is formed adjacent the heat recovery section 26 for receiving the gases from the heat recovery section 26 and introducing the gases to an air heater 32 disposed adjacent the heat recovery section 26. A forced draft fan 34 is connected to, and in fluid communication with, the air heater 32 for introducing relatively cool air into the air heater 32. The cool air is mixed with the relatively hot gases passing through the air heater 32. The gases, now a mixture of air and gas, discharge from the air heater 32 into a duct 36 for directing the gases to a baghouse 38 disposed adjacent to the air heater 32.

The baghouse 38 is of conventional construction and contains fabric filters (not shown) for providing a final separation of very fine solid particles from the gases received from the air heater 32. An induced draft fan (not shown) is connected to an outlet duct 40 extending from the baghouse 38 for drawing the gases through the fabric filters into the duct 40. A branch duct 42 is connected to, and in fluid communication with, the outlet duct 40 to direct a portion of the clean gases back to the loopseal 28 for assisting in the passing of the solids through the loopseal 28, and the outlet duct 40 directs the remaining portion of the clean gases to an external source (not shown). A forced draft fan 44 is connected to, registers with, and forces the recycled air from, the branch duct 42 into two ducts 46 and 48, which are connected to, and register with, the loopseal 28. A pair of hopper sections 50*a* and 50*b* are connected to the lower portion of the baghouse 38 for receiving the fine solid particles from the baghouse 38 and directing the separated or filtered solid material to a waste area (not shown).

In operation, particulate fuel material and adsorbent material, as needed, are introduced into the enclosure 12*a* from feeders or the like (not shown) through the distributor pipe 18 and the feeder inlet opening 12*c*. Pressurized air from an external source passes into and through the air plenum 12*b*, through the air distributor 14, and into the bed of particulate material 16 in the enclosure 12*a* to fluidize the particulate material.

A lightoff burner (not shown), or the like, is fired to ignite the particulate fuel material. When the temperature of the material reaches an acceptably high level, additional fuel from the feeder is discharged into the enclosure 12*a* through the distributor pipe 18 and the feeder inlet opening 12*c*.

The material in the enclosure 12*a* is self-combusted by the heat in the furnace section 12 and the mixture of air and gaseous products of combustion passes upwardly through the enclosure 12*a* and entrain, or elutriate, the particulate material in the enclosure 12*a*. The velocity of the air introduced into the air plenum 12*b*, which passes through the air distributor 14 and into the interior of the enclosure 12*a* is controlled in accordance with the size of the particulate material in the enclosure 12*a* so that a circulating fluidized bed is formed, i.e. the particulate material is fluidized to an extent that substantial entrainment or elutriation of the particulate material in the bed is achieved. Thus, the gaseous mixture passing into the upper portion of the enclosure 12*a* is substantially saturated with the particulate material, and the gaseous mixture thus formed exits through the duct 20, and passes into the cyclone separator 22.

In the separator 22, the gaseous mixture circles the inner barrel 22*a* in the annular chamber 22*b* and a portion of the entrained solid particulate material is separated from the gases by centrifugal forces. The solid particulate material falls into the hopper 23 and passes, via the loopseal 28, back into the enclosure 12*a* through the recycle inlet opening 12*d* where it mixes with the particulate material in the furnace section 12. The gases from the separator 22 pass upwardly through the inner barrel 22*a* and pass to the heat recovery section 26, via the duct 24.

Heat is removed from the gases as they pass through the heat recovery section 26 before the gases pass into the air heater 32, via the duct 30. The gases are mixed with relatively cool air supplied by the forced draft fan 34 in the air heater 32 and the gases, now a mixture of gases and air, exit the air heater through the duct 36. The duct 36 directs the gases into the baghouse 38 where the gases are drawn through the bag filters by the above-mentioned induced draft fan to separate or remove the very fine solid material from the gases. The separated solid material collected by the filters falls into the hopper sections 50*a* and 50*b* and is passed to a waste area (not shown).

A portion of the cleaned gases from the baghouse 38 are recycled to the loopseal 28 via the branch duct 42, the forced draft fan 44, and the ducts 46 and 48. The gases are used to assist in passing the solid particulate material from the cyclone separator 22 through the loopseal 28. As a result of the combustion in the furnace section 12, the gases contain approximately 3–7% oxygen, which allows the gas and particulate material mixture to flow through the loopseal 28 without the particulate material oxidizing or burning, thus avoiding the problems set forth above.

Water is passed through the tubes forming the walls of the enclosure 12*a* and the heat exchange tubes in the heat recovery section 26 to extract heat from the particulate material in the enclosure 12*a* and from the gases in the heat recovery section 26, to progressively convert the water to steam. It is understood that flow circuitry can be provided as necessary to promote the fluid flow.

Although not specifically illustrated in the drawing, it is understood that additional necessary equipment and structural components will be provided, and that these and all of the components described above are arranged and supported in any appropriate fashion to form a complete and operative system.

It is also understood that variations may be made in the method of the present invention without departing from the scope of the invention. For example, the fluidized bed reactor need not be of the "circulating" type but could be any other type of fluidized bed in which the recycling of the solids increases the efficiency of the overall system.

A latitude of modification, change, and substitution is intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A fluidized bed steam generation system comprising a furnace section for receiving a fluidized bed of particulate material including fuel and for combusting said fuel to form a mixture of entrained particulate material and gases, means for separating a first portion of said entrained particulate material from said gases, means for connecting said separating means with said furnace section to pass said first portion of separated particulate material from said separating means to said furnace section, a baghouse section for receiving said gases from said separating means and for separating a second portion of particulate material from said gases, and means for passing at least a portion of said separated gases back into said connecting means to assist in passing said first portion of separated particulate material through said connecting means, and back into said furnace section.

2. The system of claim 1 wherein said passing means passes said separated gases from said baghouse back to said connecting means.

3. The system of claim 1 further comprising a heat recovery section for receiving said separated gases from said separating means and for recovering a portion of the heat contained in said separated gases.

4. The system of claim 3 further comprising means for passing water in a heat exchange relation to the particulate material in said furnace section and to the separated gases in said heat recovery section for adding heat to said water and converting it to steam.

5. The system of claim 4 wherein said water passing means includes a plurality of water tubes forming at least a portion of the walls of said furnace section.

6. The system of claim 3 further comprising an air heater section for receiving said separated gases from said heat recovery section, means for introducing air into said air heater section to mix with said separated gases to form a gaseous mixture, and passing said gaseous mixture to said baghouse.

7. The system of claim 6 wherein said air introduction means includes a forced draft fan connected to and integral with said air heater section.

8. The system of claim 1 wherein said connecting means includes a loopseal for directing said particulate material from said separator section to said furnace section.

9. The system of claim 8 wherein said connecting means further comprises a J-valve to prevent backflow of said particulate material from said furnace section.

10. A method of generating steam comprising the steps of fluidizing a bed of particulate material including fuel in a furnace section, combusting said fluidized particulate material in said furnace section to form a mixture of entrained particulate material and gases, separating a first portion of said entrained particulate material from said gases, passing said first portion of separated particulate material back to said furnace section, separating a second portion of particulate material from said gases and passing at least a portion of said separated gases to said first portion of separated particulate material to assist in passing said first portion of separated particulate material back to said furnace section.

11. The method of claim 10 wherein said gases passed to said separated particulate material have said second portion of particulate material separated therefrom.

12. The method of claim 10 further comprising the step of mixing air with said separated gases after said first separating step.

13. The method of claim 12 further comprising the step of recovering heat from said separated gases from said first separating step before said mixing step.

14. The method of claim 13 further comprising the step of passing water in a heat exchange relation to the particulate material in said furnace section and to the separated gases for adding heat to said water and converting it to steam.

15. The method of claim 14 wherein said step of passing water includes passing water through at least a portion of the walls of said furnace section.

* * * * *